US007800293B2

(12) United States Patent
Qian et al.

(10) Patent No.: US 7,800,293 B2
(45) Date of Patent: Sep. 21, 2010

(54) FIELD EMISSION LAMP AND METHOD FOR MAKING THE SAME

(75) Inventors: Li Qian, Beijing (CN); Liang Liu, Beijing (CN); Peng Liu, Beijing (CN); Jie Tang, Beijing (CN); Yang Wei, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 725 days.

(21) Appl. No.: 11/603,640

(22) Filed: Nov. 21, 2006

(65) Prior Publication Data

US 2007/0228919 A1 Oct. 4, 2007

(30) Foreign Application Priority Data

Mar. 31, 2006 (CN) ..... 2006 1 0060131

(51) Int. Cl.
*H01J 1/62* (2006.01)

(52) U.S. Cl. ..... 313/496; 313/310; 445/51

(58) Field of Classification Search ..... 313/495–497, 313/306, 309–310, 346, 355, 293–304, 414, 313/441–460, 351
See application file for complete search history.

(56) References Cited

U.S. PATENT DOCUMENTS

| | | | | |
|---|---|---|---|---|
| 4,096,405 | A * | 6/1978 | Goto | 313/554 |
| 4,146,497 | A * | 3/1979 | Barosi et al. | 252/181.6 |
| 6,156,433 | A * | 12/2000 | Hatori et al. | 428/411.1 |
| 7,332,856 | B2 * | 2/2008 | Kijima et al. | 313/495 |
| 7,438,829 | B2 * | 10/2008 | Cho et al. | 252/181.1 |
| 2001/0015604 | A1 * | 8/2001 | Kerslick et al. | 313/310 |
| 2002/0070648 | A1 * | 6/2002 | Forsberg | 313/309 |
| 2002/0074932 | A1 * | 6/2002 | Bouchard et al. | 313/495 |
| 2002/0089289 | A1 * | 7/2002 | Kim | 315/169.1 |
| 2003/0001492 | A1 * | 1/2003 | Pei et al. | 313/496 |
| 2003/0160561 | A1 * | 8/2003 | Park et al. | 313/495 |
| 2004/0070326 | A1 * | 4/2004 | Mao et al. | 313/311 |

(Continued)

OTHER PUBLICATIONS

Croci, Mirko et al , Microelectronics Journal #35 (2004), pp. 329-336 (copyright 2003), El Sevier.*

*Primary Examiner*—Peter J Macchiarolo
*Assistant Examiner*—Donald L Raleigh
(74) *Attorney, Agent, or Firm*—Jeffrey T. Knapp

(57) ABSTRACT

A field emission lamp generally includes a tube having at least one open end, at least one sealing member respectively arranged in a corresponding open end of the tube, an anode, and a cathode. The anode includes an anode conductive layer formed on an inner surface of the tube, a fluorescent layer formed on the anode conductive layer, and at least one anode electrode electrically connected with the anode conductive layer and extending out of the at least one sealing member. The cathode includes an electron emission element and at least one cathode electrode electrically connected with the electron emission element and extending out of the at least one sealing member. The electron emission element has an electron emission layer. The electron emission layer includes getter powders therein to exhaust unwanted gas in the field emission lamp, thereby ensuring the field emission lamp with a high degree of vacuum during operation thereof. A method for making such field emission lamp is also provided.

20 Claims, 3 Drawing Sheets

U.S. PATENT DOCUMENTS

2004/0195950 A1* 10/2004 Ryu et al. ..... 313/311
2005/0258737 A1* 11/2005 Shin ..... 313/496
2006/0090996 A1* 5/2006 Yaniv et al. ..... 204/157.15
2007/0205720 A1* 9/2007 Sparks et al. ..... 313/553

* cited by examiner

FIELD EMISSION LAMP AND METHOD FOR MAKING THE SAME

RELATED APPLICATIONS

This application is related to commonly-assigned applications entitled, "FIELD EMISSION LAMP AND METHOD FOR MAKING THE SAME", filed Nov. 21, 2006 application Ser. No. 11/603,628, "FIELD EMISSION DOUBLE-PLANE LIGHT SOURCE AND METHOD FOR MAKING THE SAME", filed Nov. 21, 2006 application Ser. No. 11/603,627, "FIELD EMISSION ELECTRON SOURCE AND METHOD FOR MAKING THE SAME", filed Nov. 21, 2006 application Ser. No. 11/603,672, and "FIELD EMISSION PLANE LIGHT SOURCE AND METHOD FOR MAKING THE SAME", filed Nov. 21, 2006 application Ser. No. 11/603,639, the contents of each of which is hereby incorporated by reference thereto.

BACKGROUND

1. Technical Field

The invention relates generally to cold cathode luminescent field emission devices and, particularly, to a field emission lamp employing a getter to exhaust unwanted gas from therein, thereby ensuring a high degree of vacuum. The invention also relates to a method for making a field emission lamp.

2. Discussion of Related Art

Electrical lamps for daily living are usually incandescent lamps and/or fluorescent lamps. Ever since Thomas Edison invented the first viable incandescent lamps in 1879, the incandescent lamps have a long history for simple fabrication thereof. However, because an incandescent lamp emits light by incandescence of a tungsten filament, most of electric energy used therein is converted into heat and thereby is wasted. Therefore, a main drawback of the incandescent lamp is the low energy efficiency thereof.

A typical conventional fluorescent lamp generally includes a transparent glass tube. The transparent glass tube has a white or colored fluorescent material coated on an inner surface thereof and a certain amount of mercury vapor filled therein. In use, electrons are accelerated by an electric field and the accelerated electrons collide with the mercury vapor. This collision causes excitation of the mercury vapor and causes radiation of ultraviolet rays. The ultraviolet rays irradiate the fluorescent material, whereby the ultraviolet rays are converted into visible light. Compared with the incandescent lamps, the fluorescent lamps have higher electrical energy utilization ratios. However, when the glass tube is broken, the mercury vapor is prone to leak out and, thus, is poisonous and noxious to humans and is environmentally unsafe.

To settle the above problems, a kind of fluorescent lamps (i.e., field emission lamps) not adopting the mercury vapor has been developed. A conventional field emission lamp without the mercury vapor generally includes a cathode and an anode. The cathode has a number of nanotubes formed on a surface thereof, and the anode has a fluorescent layer facing the nanotube layer of the cathode. In use, a strong electrical field is provided to excite the nanotubes. A certain amount of electrons is then accelerated and emitted from the nanotubes, and such electrodes collide with the fluorescent layer of the anode, thereby producing visible light.

For a field emission lamp, a high degree of vacuum in an inner portion (i.e., interior) thereof is a virtual necessity. In general, the better of the degree of vacuum of the field emission lamp is able to maintain during the sealing process and thereafter during use, the better of the field emission performance thereof is. To maintain the degree of vacuum of the field emission lamp within a desired range, a conventional way is to provide a getter in the inner portion thereof. Such a getter is able to exhaust a gas produced by the fluorescent layer and/or any residual gas remaining within the field emission lamp upon sealing and evacuation thereof. The getter is generally selected from a group consisting of non-evaporable getters and evaporable getters.

For the evaporable getter, a high temperature evaporating process has to be provided during the fabrication of the field emission lamp, and a plane arranged in the inner portion of the field emission lamp has to be provided to receive the evaporated getter. Thus, the cost of the fabrication of the field emission lamp increases, and the cathode and anode are prone to shorting during the high temperature evaporating process, thereby causing the failure of the field emission lamp. For the non-evaporable getter, it is generally focused in a position away from the cathode. Thus, the degree of vacuum of portions near to the cathode tends to be poorer, in the short-term, than that of portions near to the getter, at least until internal equilibrium can be reached, thereby decreasing the field emission performance of the cathode or at least potentially resulting in a fluctuating performance thereof.

What is needed, therefore, is a field emission lamp that overcomes the above-mentioned shortcomings to ensure a high degree of vacuum thereof, thus providing a better and more steady field emission performance during the use thereof.

What is also needed is a method for making such a field emission lamp.

SUMMARY

A field emission lamp includes a transparent tube, at least one sealing member, an anode, and a cathode. The tube has at least one open end. The at least one sealing member is assembled in the at least one open end of the tube. The anode includes an anode conductive layer, a fluorescent layer, and at least one anode electrode. The anode conductive layer is formed on an inner surface of the tube, and the fluorescent layer is created on a portion of a surface of the anode conductive layer. The at least one anode electrode electrically connects with the anode conductive layer and extends out of the at least one sealing member to form at least one anode outer electrode. The cathode includes an electron emission element and the at least one cathode electrode. The electron emission element is disposed in the tube. The at least one cathode electrode is disposed on and electrically connects with at least one end of the electron emission element and extends out of the at least one sealing member to provide at least one cathode outer electrode. The electron emission layer includes a glass matrix and a plurality of carbon nanotubes, getter powders, and metallic conductive particles dispersed therein.

A method for making a field emission lamp including:

(a) providing a transparent glass tube with at least one open end; at least one anode electrode; at least one cathode electrode; a conductive body (e.g., a metallic base member); at least one sealing member; and a certain number of carbon nanotubes, metallic conductive particles, glass particles (later melted to form a glass matrix), and getter powders (i.e., in particulate or granular form), the tube having an anode conductive layer on an inner surface thereof and a fluorescent layer directly on an inner surface of the anode conductive layer, the fluorescent layer facing the tube interior;

(b) mixing the nanotubes, the metallic conductive particles, the glass particles, and the getter powders in an organic medium to form an admixture;

(c) forming a layer of the admixture on a surface of the conductive body;

(d) drying and then baking the admixture at a temperature of about 300° C. to about 600° C. to soften and/or melt the glass particles to result in the glass matrix with the nanotubes, the metallic conductive particles, and the getter powders dispersed therein, in order to yield an electron emission layer on the conductive body and thereby obtaining an electron emission element;

(e) assembling the tube, the at least one anode electrode, the at least one cathode electrode, the electron emission element, and the at least one sealing members, securing the at least one anode electrodes and the at least one cathode electrodes with the at least one sealing member; and (f) sealing and evacuating the tube, thereby yielding the field emission lamp.

Other advantages and novel features of the present field emission lamp and the relating method thereof will become more apparent from the following detailed description of preferred embodiments when taken in conjunction with the accompanying drawings.

BRIEF DESCRIPTION OF THE DRAWINGS

Many aspects of the present field emission lamp and the related method of making such can be better understood with reference to the following drawings. The components in the drawings are not necessarily to scale, the emphasis instead being placed upon clearly illustrating the principles of the present field emission lamp and the related method of making such. Moreover, in the drawings, like reference numerals designate corresponding parts throughout the several views.

The exemplifications set out herein illustrate at least one preferred embodiment of the present field emission lamp and the relating method thereof, in one form, and such exemplifications are not to be construed as limiting the scope of such a field emission lamp and a method for making such in any manner.

DETAILED DESCRIPTION

Reference will now be made to the drawings to describe, in detail, the field emission lamp and the method for making the same, according to the present embodiment.

Figure 1:
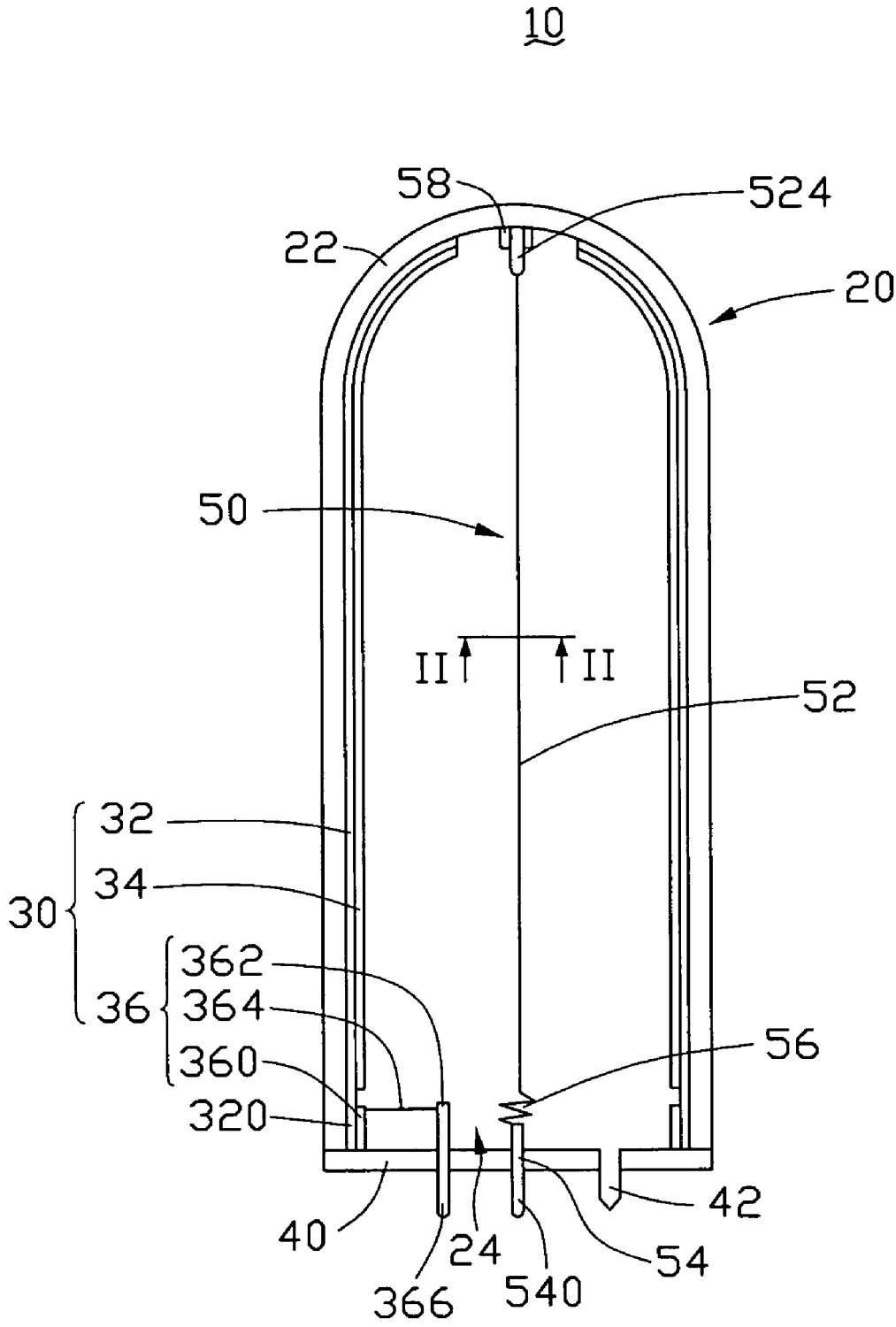
FIG. 1 is a cross-section view of a field emission lamp, in accordance with an exemplary embodiment of the present device.

Referring to FIG. 1, a field emission lamp 10, in accordance with an exemplary embodiment of the present device, is provided. The field emission lamp 10 includes a transparent glass tube 20, an anode 30, a sealing member 40, and a cathode 50.

A diameter of the tube 20 is in the range from about 2 millimeters to about 40 millimeters. The tube 20 has a semicircular sealed end 22 and an open end 24.

The anode 30 includes an anode conductive layer 32 formed directly on an inner surface of the tube 20, a fluorescent layer 34 deposited in contact with a surface of the anode conductive layer 32 facing the tube interior, and an anode electrode 36. The anode conductive layer 32 partly covers the inner surface of the tube 20, specifically, except for a middle portion of the sealed end 22 of the tube 20. The anode conductive layer 32 is a transparent conductive film, such as an indium tin oxide (ITO) film. The fluorescent layer 34 partly covers the anode conductive layer 32, leaving the anode conductive layer 32 exposed at the open end 24 of the tube 20, and, thus, forming an exposed conductive portion 320. The fluorescent layer 34 is advantageously made of one of a white or color fluorescent material, with such a fluorescent material usefully having many satisfactory characteristics (e.g., a high optical-electrical transferring efficiency, a low voltage, a long afterglow luminescence, etc.). Alternatively, an aluminum layer (not shown in the drawings) can be formed on a surface of the fluorescent layer 34. Such an aluminum layer can help improve the brightness of the field emission lamp (due, e.g., to its high conductivity and its reflective nature) and help prevent premature failure of the fluorescent layer 34, reinforcing the layer and reducing the chances of spalling thereof.

The anode electrode 36 includes an anode down-lead ring 360, an anode down-lead pole 362, and an anode down-lead wire 364. The anode down-lead ring 360 is disposed on the exposed conductive portion 320 and thus electrically connected therewith. The anode down-lead pole 362 is arranged parallel to a central axis of the tube 20 and is secured on the sealing member 40. One end of the anode down-lead pole 362 is in the tube 20 and electrically connects with the anode down-lead ring 360 by the anode down-lead wire 364. Meanwhile, the other end of the anode down-lead pole 362 extends out of the sealing member 40 to form an anode outer electrode 366. The anode down-lead ring 360, anode down-lead pole 362, and anode down-lead wires 364 are, respectively, made of a conductive material (e.g., copper, etc.), and the arrangements thereof are done in a manner so as to provide the anode outer electrode 366. Alternatively, the anode electrode 36 can have other configurations, such as a pole or a wire provided to electrically connect with the anode conductive layer 32 and extend out of the sealing member 40 or such as a ring provided on the exposed conductive portion 320 of the anode conductive layer 32 and a wire or a pole provided to electrically connect with the ring and extend out of the sealing member 40.

Figure 2:
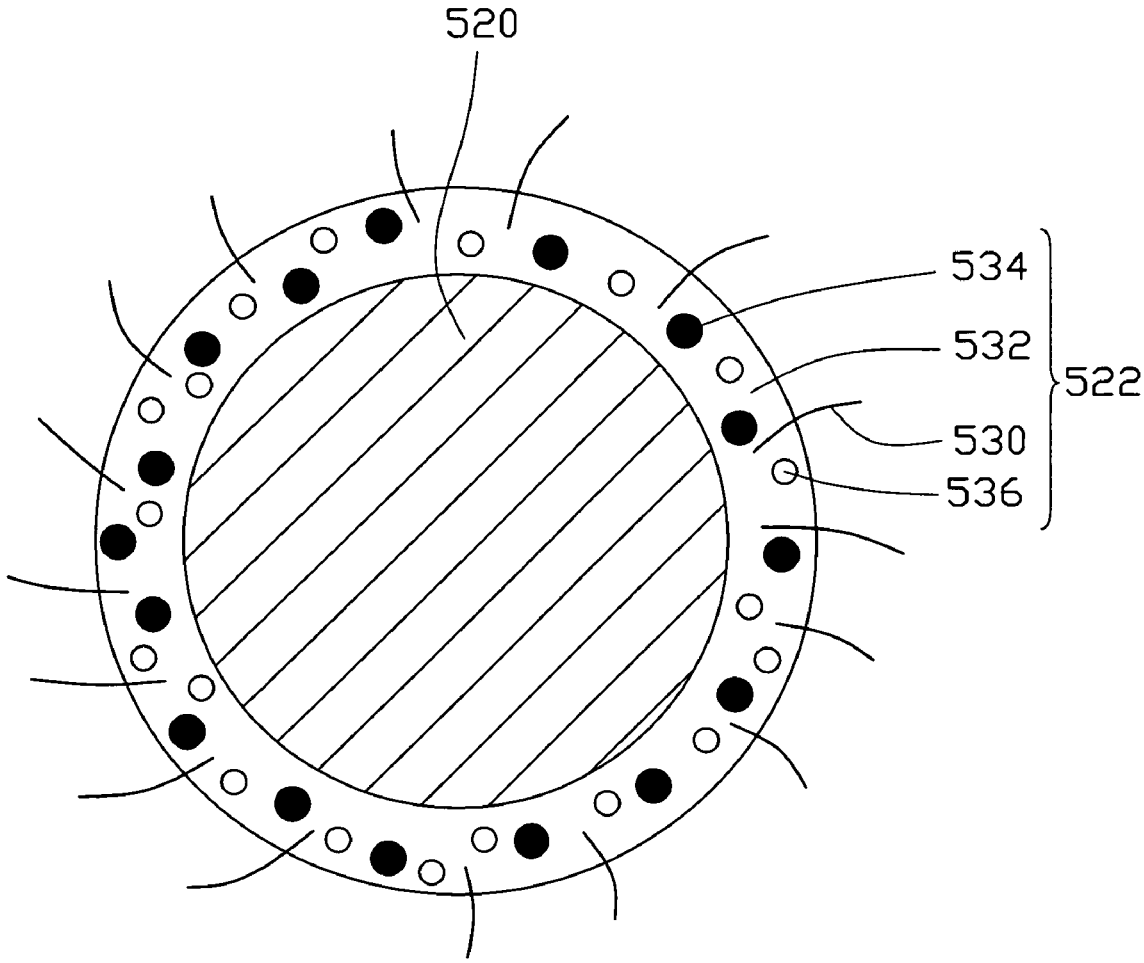
FIG. 2 is an enlarged view along a line II-II of FIG. 1.

The cathode 50 includes an electron emission element 52 and a cathode electrode 54. Referring to FIG. 2, the electron emission element 52 includes a conductive body 520 (e.g., a metallic base member) and an electron emission layer 522 formed on a surface of the conductive body 520. The conductive body 520 is configured as a pole or a wire with a proper diameter (i.e., above 0.3 millimeter). One end of the conductive body 520 is secured onto the middle portion of the sealed end 22 of the tube 20 by, e.g., a securing pole 524, and the other end thereof electrically connects with the cathode electrode 54. The cathode electrode 54 is generally a cathode down-lead pole, with one end thereof electrically connecting with the conductive body 520 and the other end thereof extending out of the sealing member 40 to form a cathode outer electrode 540. The arrangement of the cathode electrode 54 is chosen so as to provide for the cathode outer electrode 540. Alternatively, the cathode electrode 54 can have other configurations, such as the end of the conductive body 520 extending out of the sealing member 40 to directly form a cathode outer electrode.

Alternatively, a coil spring 56 could be arranged between the end of the conductive body 520 and the cathode down-lead pole 54. When the conductive body 520 expands or contracts due to heating or cooling, the spring 56 could, likewise, be elongated or compressed and, thus, decrease/avoid unexpected failures thereof.

The electron emission layer 522 includes a plurality of carbon nanotubes 530, metallic conductive particles 534, and getter powders 536; and a glass matrix 532. Preferably, a length of each of the nanotubes 530 is in the approximate range from 5 micrometers to 15 micrometers, and a diameter thereof is in the range from about 1 nanometer to about 100 nanometers. An end of each nanotube 530 is advantageously exposed out of a top surface of the electron emission layer 522 and extends toward the tube 20. Meanwhile, the remainder of each nanotube 530 is anchored/embedded within the electron emission layer 522. The metallic conductive particles 534 are usefully made of a conductive material, such as silver (Ag) or indium tin oxide (ITO), and are used to electrically connect the body 520 with the nanotubes 530. The getter powders 536 are most suitably made of a non-evaporating getter material (e.g., a material selected from the group consisting of titanium (Ti), zirconium (Zr), hafnium (Hf), thorium (Th), aluminum (Al), thulium (Tm), and alloys substantially composed of at least two such metals.). The average diameter of the getter powders 536 is in the range from about 1 micrometer to about 10 micrometers.

Alternatively, an insulative medium 58 is provided between the cathode securing pole 524 and the anode conductive layer 32, in order to increase the insulative performance therebetween. The insulative medium 58 is made of a proper insulative material (e.g., glass or ceramic).

The sealing member 40 is assembled in the open end 24 of the tube 20, thereby forming a closed-off/sealed inner portion (i.e., interior) of the tube 20. The interior can thereby be evacuated and such a vacuum maintained upon seal completion, facilitating the operation of the field emission lamp 10. Alternatively, a pipe 42 may be arranged within the sealing member 40. One end of the pipe 42 would be in communication with the inner portion of the tube 20, and the other end thereof would extend out of the sealing member 40. The pipe 42 would provide a vent to help evacuate the gas from in the inner portion of the tube 20 and/or provide a path via which an amount of an inert gas could be introduced into the tube 20. After venting/evacuation and/or inert gas introduction, the pipe 42 would then be hermetically sealed to maintain the desired environmental conditions within the tube 20.

In use, the anode outer electrode 366 is grounded, and an appropriate negative voltage is applied to the cathode outer electrode 540, resulting in a strong electrical field between the anode conductive layer 32 of the anode 30 and the electron emission layer 522 of the cathode 50. The strong field excites the carbon nanotubes 530 in the electron emission layer 522 to emit electrons. The electrons bombard the fluorescent layer 34, thereby producing visible light. Furthermore, the getter powders 536 exhaust gases produced by the fluorescent layer 34 and/or any residual gas in the field emission lamp 10 remaining upon evacuation, thus ensuring the field emission lamp 10 with a high degree of vacuum throughout its usage lifetime.

Figure 3:
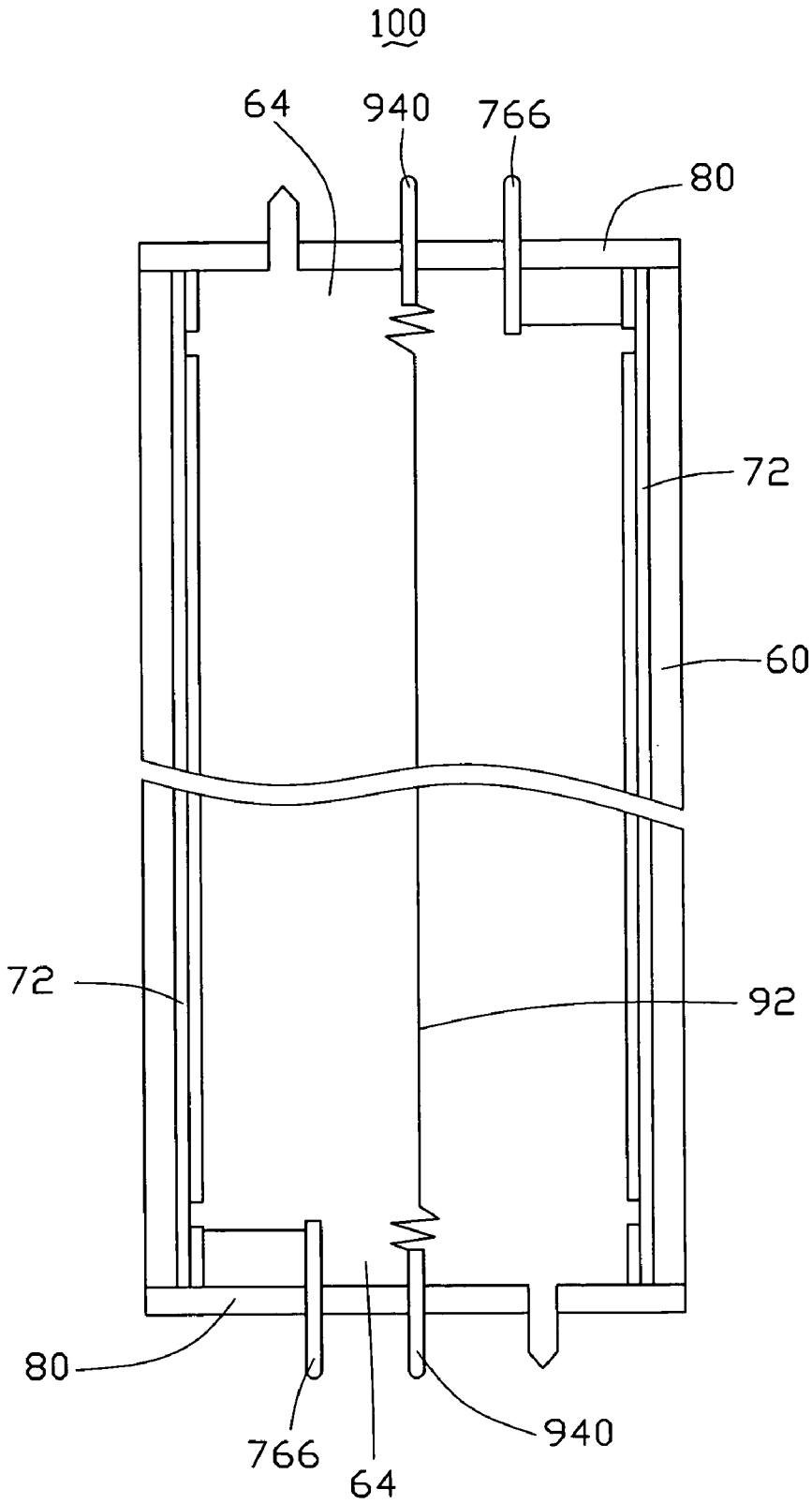
FIG. 3 is a cross-section view of a field emission lamp, in accordance with an alternative embodiment of the present device.

Referring to FIG. 3, an alternative field emission lamp 100 is provided, in accordance with the scope of the concept of the present lamp. The field emission lamp 100 includes a tube 60 having two open ends 64. An anode conductive layer 72 is directly formed on an inner surface of the tube 60, and a fluorescent layer (not labeled) is formed on the anode conductive layer 72. A pair of sealing members 80 is respectively arranged in the open ends 64 of the tube 60. A pair of anode electrodes, each of which has a similar configuration with the above-mentioned anode electrode 36, is arranged, one each, on two opposite ends of the anode conductive layer 72 to provide a pair of anode outer electrodes 766. A pair of cathode electrodes, each of which has a similar configuration with the above-mentioned cathode electrode 54, is arranged, respectively, in the sealing members 80 and extend therethrough, out of the tube 60, to provide a pair of cathode outer electrodes 940. An electron emission element 92, which has a similar configuration with the above-mentioned electron emission element 52, is arranged with ends thereof respectively connecting with the cathode electrodes.

A method for making the above-mentioned field emission lamp 10, 100 generally includes:

(a) providing a transparent glass tube 20, 60 with at least one open end 24, 64; at least one anode electrode 36; at least one cathode electrode 54; a conductive body 520 (e.g., a metallic base member); at least one sealing member 40, 80; and a certain number of carbon nanotubes 530, metallic conductive particles 534, glass particles (later melted to form a glass matrix 532), and getter powders 536 (i.e., in particulate or granular form); the tube 20, 60 having an anode conductive layer 32, 72 on an inner surface thereof and a fluorescent layer 34 directly on an inner surface of the anode conductive layer 32, 72, the fluorescent layer 34 facing the tube interior;

(b) mixing the nanotubes 530, the metallic conductive particles 534, the glass particles, and the getter powders 536 in an organic medium to form an admixture;

(c) forming a layer of the admixture on a surface of the conductive body 520;

(d) drying and then baking the admixture at a temperature of about 300° C. to about 600° C. to soften and/or melt the glass particles to result in the glass matrix 532 with the nanotubes 530, the metallic conductive particles 534 and the getter powders 536 dispersed therein, in order to yield an electron emission layer 522 on the conductive body 520 and to thereby obtain an electron emission element 52, 92;

(e) assembling the tube 20, 60, the at least one anode electrode 36, the at least one cathode electrode 54, the electron emission element 52, 92, and the at least one sealing members 40, 80, securing the at least one anode electrode 36 and the at least one cathode electrode 54 within the at least one sealing member 40, 80; and (f) sealing and evacuating the tube 20, 60, thereby yielding the field emission lamp 10, 100.

In step (a), the carbon nanotubes 530 are formed by an appropriate technology (e.g., a chemical vapor deposition (CVD) method, an arc-discharge method, a laser ablation method, a gas phase combustion synthesis method, etc.). Preferably, the average length of the nanotubes is in the range from about 5 micrometers to about 15 micrometers. The glass particles are selected from glass powders with a low melting temperature (e.g., glass powders with a low melting temperature in the range of about 350° C. to about 600° C., and preferably composed, in part, of silicon oxide ($SiO_2$), boric trioxide ($B_2O_3$), zinc oxide (ZnO), and vanadium pentoxide ($V_2O_5$)). The average diameter of the glass particles is preferably in the range of about 10 nanometers to about 100 nanometers. The metallic conductive particles 534 are ball-milled, yielding particle diameters in the range from about 0.1 micrometer to about 10 micrometers. The getter powders 536 are also ball-milled, yielding powder diameters in the range from about 1 micrometer to about 10 micrometers. Preferably, the getter powders are made of a getter material with an activity temperature of about 300° C. to about 500° C. (e.g., an alloy containing Zr and Al). The anode conductive layer 32 is formed directly on the inner surface of the bulb 20 (i.e., a surface facing the bulb interior and the cathode 50) by, e.g., a sputtering method or a thermal evaporating method. The fluorescent layer 34 is formed on and in contact with the anode conductive layer 32 by a depositing method.

In step (b), the organic medium is composed of a certain amount of solvent (e.g., terpineol, etc.), and a smaller amount of a plasticizer (e.g., dimethyl phthalate, etc.) and a stabilizer (e.g., ethyl cellulose, etc.). The percent by mass of the getter powders 536 is in the range of about 40% to about 80% of the admixture. The process of the mixing is preferably performed at a temperature of about 60° C. to about 80° C. for a sufficient period of time (e.g., about 3 hours to about 5 hours). Furthermore, low-power ultrasound is preferably applied in step (b), to improve the dispersion of the carbon nanotubes 530, the metallic conductive particles 534, and the getter powders 536.

Step (c) is performed in a condition of a low dust content (e.g., being preferably lower than 1000 mg/m$^3$).

In step (d), the process of drying volatilizes the organic medium from the conductive body 520, and the process of baking melts or at least softens the glass particles to permit the flow thereof in order to form the glass matrix 532 of the electron emission layer 522. The processes of drying and baking are performed in a vacuum condition and/or in a flow of protective/inert gas (e.g., noble gas, nitrogen). After baking, an outer surface of the electron emission layer 522 is advantageously abraded and/or selectively etched, in order to expose ends of at least a portion of the nanotubes 530. The exposure of such ends increases the field emission performance of the electron emission layer 522.

In step (f), a sealing material (e.g., a glass with a melting temperature of about 350° C. to about 600° C.) is applied so as to extend between the at least one sealing member 40, 80 and the tube 20 and soften/formed at a temperature of about 400° C. to about 500° C. After cooling, the sealing material helps establish a sealed chamber within the field emission lamp 10. Alternatively, a vacuum pump is provided to evacuate the gas maintaining in the tube 20, 60 via a pipe 42 disposed in the at least one sealing member 40, 80. (As alluded to above, the pipe 42 could additionally be used to provide an amount of an inert gas into the tube 20. In this manner, the final interior environment would essentially be a vacuum with a very small partial pressure of the inert gas, in a manner consistent with that known in the art.) The end of the pipe 42 is then sealed.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A field emission lamp comprising:

a transparent tube having at least one open end;

at least one sealing member, a respective sealing member being assembled in a corresponding open end of the tube;

an anode comprising an anode conductive layer, a fluorescent layer, and at least one anode electrode, the anode conductive layer being formed on an inner surface of the tube, the fluorescent layer being created on a portion of a surface of the anode conductive layer, the at least one anode electrode electrically connecting with the anode conductive layer and extending out of the at least one sealing member to form at least one anode outer electrode; and a cathode comprising an electron emission element and at least one cathode electrode, the electron emission element being disposed in the tube, the at least one cathode electrode being disposed on and electrically connecting with at least one end of the electron emission element and extending out of the at least one sealing member to provide at least one cathode outer electrode, the electron emission element comprising an electron emission layer, the electron emission layer comprising a glass matrix and a plurality of carbon nanotubes, getter powders, and metallic conductive particles dispersed therein.

2. The field emission lamp as described in claim 1, wherein the getter powders are comprised of a non-evaporating getter material.

3. The field emission lamp as described in claim 1, wherein an average diameter of the getter powders is in the range from about 1 micrometer to about 10 micrometers.

4. The field emission lamp as described in claim 1, wherein the getter powders are comprised of at least one material selected from the group consisting of titanium, zirconium, hafnium, thorium, aluminum, and thulium.

5. The field emission lamp as described in claim 1, wherein an average diameter of the nanotubes is in the range from about 1 nanometer to about 100 nanometers, and an average length thereof is in the range from about 5 micrometers to about 15 micrometers.

6. The field emission lamp as described in claim 1, wherein the metallic conductive particles are comprised of a material selected from indium tin oxide and silver, and an average diameter thereof is in the range of about 0.1 micrometer to about 10 micrometers.

7. The field emission lamp as described in claim 1, wherein each cathode electrode comprises a cathode down-lead pole and a spring, the cathode down-lead pole is disposed in the sealing member with one end thereof extending out of the sealing member and the tube, and the spring electrically connects the other end of the cathode down-lead pole with the electron emission element.

8. The field emission lamp as described in claim 1, wherein each anode electrode comprises an anode down-lead wire, an anode down-lead pole disposed on the sealing member, and an anode down-lead ring disposed on the exposed portion of the anode conductive layer, the anode down-lead wire electrically connects one end of the anode down-lead pole with the anode down-lead ring, and the other end of the anode down-lead pole extends out of the sealing member to act as the anode outer electrode.

9. The field emission lamp as described in claim 1, wherein the tube comprises a sealed end having a securing pole in a middle portion thereof, and the securing pole is insulated from the anode conductive layer and connects with one end of the electrode emission body.

10. A method for making a field emission lamp comprising:

providing a transparent glass tube with at least one open end; at least one anode electrode; at least one cathode electrode; a conductive body; at least one sealing member; and a plurality of carbon nanotubes, metallic conductive particles, glass particles, and getter powders, the tube comprising an anode conductive layer on an inner surface thereof and a fluorescent layer on a surface of the anode conductive layer;

mixing the nanotubes, the metallic conductive particles, the glass particles and the getter powders in an organic medium to form an admixture;

forming a layer of the admixture on a surface of the conductive body;

drying and then baking the admixture at a temperature of about 300° C. to about 600° C. to at least one of soften and melt the glass particles to result in a glass matrix with the nanotubes, metallic conductive particles, and getter powders therein, in order to yield an electron emission layer on the conductive body and to thereby obtain an electron emission element; and thereafter, assembling the tube, the at least one anode electrode, the at least one cathode electrode, the electron emission element, and the at least one sealing member together, and sealing the tube to thus form the field emission lamp.

11. The method for making the field emission lamp as described in claim 10, wherein the getter powders are comprised of a non-evaporating getter material having an activity temperature of about 300° C. to about 500° C.

12. The method for making the field emission lamp as described in claim 10, wherein an average diameter of the glass particles is in the range from about 10 nanometers to about 100 nanometers, and the melting temperature thereof is in the range from about 350° C. to about 600° C.

13. The method for making the field emission lamp as described in claim 10, wherein the percent by mass of the getter powders is in the range of about 40% to about 80% of the admixture.

14. The method for making the field emission lamp as described in claim 10, wherein the process of mixing the nanotubes, the getter powders, the glass particles, and the metallic conductive particles is performed at a temperature of about 60° C. to about 80° C. for a time of about 3 hours to about 5 hours.

15. The method for making the field emission lamp as described in claim 10, wherein the drying and baking processes is performed at least one of in a vacuum condition and under a flow of an inert gas.

16. The method for making the field emission lamp as described in claim 10, wherein after forming the electron emission element, a surface of the electron emission layer is at least one of abraded and etched to expose ends of the nanotubes.

17. The method for making the field emission lamp as described in claim 10, wherein during a step of sealing the tube, a sealing material is applied between the at least one sealing member and the at least one open end of the tube and heated up to a temperature of about 400° C. to about 500° C.

18. A field emission lamp comprising:

a tube;

an anode comprising an anode conductive layer, a fluorescent layer, and at least one anode electrode, the anode conductive layer being formed on an inner surface of the tube, the fluorescent layer being created on a portion of a surface of the anode conductive layer, the at least one anode electrode electrically connecting with the anode conductive layer and extending out of the tube to form at least one anode outer electrode; and a cathode comprising an electron emission element and a cathode electrode, the electron emission element being disposed in the tube, the cathode electrode being disposed on the electron emission element and extending out of the tube to provide one cathode outer electrode, the electron emission element comprising an electron emission layer, the electron emission layer comprising a glass matrix and a plurality of carbon nanotubes, getter powders, and conductive particles dispersed therein, the conductive particles electrically connecting the nanotubes with the cathode electrode.

19. The field emission lamp as described in claim 18, wherein the electron emission element further comprises a conductive body, and the electron emission layer is attached on a surface of the conductive body, and the nanotubes are electrically connected to the cathode electrode through an electrical conductive path formed by the conductive particles and the conductive body.

20. The field emission lamp as described in claim 19, wherein each nanotube has an end exposed out of a top surface of the electron emission layer and facing the tube and the remainder of the each nanotube is embedded within the electron emission layer.

* * * * *